US007659871B2

(12) United States Patent
Kim et al.

(10) Patent No.: US 7,659,871 B2
(45) Date of Patent: Feb. 9, 2010

(54) PLASMA DISPLAY PANEL AND METHOD FOR DRIVING SAME

(75) Inventors: Ki-Dong Kim, Yongin-si (KR); Yong-Su Park, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 614 days.

(21) Appl. No.: 11/541,292

(22) Filed: Sep. 28, 2006

(65) Prior Publication Data

US 2007/0069989 A1 Mar. 29, 2007

(30) Foreign Application Priority Data

Sep. 29, 2005 (KR) ..... 10-2005-0091051

(51) Int. Cl.
*G09G 3/28* (2006.01)

(52) U.S. Cl. ..... 345/60; 345/63; 345/66; 345/67; 345/68; 345/69; 345/37; 345/41; 313/169.1; 313/169.4

(58) Field of Classification Search ..... 345/60, 345/63, 66, 67, 68, 69, 37, 41; 313/169.1–169.4
See application file for complete search history.

(56) References Cited

U.S. PATENT DOCUMENTS

| | | | |
|---|---|---|---|
| 5,701,056 | A | 12/1997 | Shinohara |
| 5,745,086 | A | 4/1998 | Weber |
| 6,242,864 | B1 | 6/2001 | Nakahara et al. |
| 6,294,875 | B1 | 9/2001 | Kurata et al. |
| 2003/0098822 | A1 | 5/2003 | Park et al. |

(Continued)

FOREIGN PATENT DOCUMENTS

| | | | |
|---|---|---|---|
| EP | 1 408 528 | A2 | 4/2004 |

(Continued)

OTHER PUBLICATIONS

Partial European Search Report dated Dec. 27, 2007 for Application No. EP 06121444.1, indicating relevance of cited references in this IDS.

(Continued)

*Primary Examiner*—Richard Hjerpe
*Assistant Examiner*—Olga Merkoulova
(74) *Attorney, Agent, or Firm*—Christie, Parker & Hale, LLP

(57) ABSTRACT

Provided are a plasma display panel (PDP) and a driving method thereof. The PDP includes a first substrate and a second substrate disposed in parallel and spaced apart from one another. Address electrodes are provided on the first substrate with a first dielectric layer over the address electrodes and the first substrate. Barrier ribs are provided on the dielectric forming a plurality of discharge spaces in which phosphor layers are provided. Sustain electrodes are formed on the second substrate facing the first substrate and are arranged crossing the address electrodes. A second dielectric layer is formed over the address electrodes and on the second substrate, and a protective layer including MgO of at least 99.6% purity by weight is formed over the second dielectric layer by a sintering process. The discharge can be stabilized by varying a Vset applying time or a Vnf voltage applying time according to the temperature of the plasma display panel, and wall charges can be sufficiently accumulated in the reset period.

8 Claims, 8 Drawing Sheets

T1 and T2 : Varied depending on temperature

U.S. PATENT DOCUMENTS

| | | | | |
|---|---|---|---|---|
| 2003/0222835 | A1 * | 12/2003 | Yoon et al. | 345/60 |
| 2004/0131884 | A1 * | 7/2004 | Park et al. | 428/690 |
| 2005/0285532 | A1 * | 12/2005 | Hasegawa et al. | 313/587 |

FOREIGN PATENT DOCUMENTS

| | | | | |
|---|---|---|---|---|
| EP | 1 548 791 | A1 | | 6/2005 |
| EP | 1 408 523 | A3 | | 7/2007 |
| JP | 07-192630 | A | | 7/1995 |
| JP | 2002-207449 | | * | 7/2002 |
| JP | 2004-226792 | A | | 8/2004 |
| JP | 2005-123172 | | | 5/2005 |
| JP | 2005-123174 | A | | 5/2005 |
| KR | 10-2004-0037270 | | | 5/2004 |
| KR | 10-2005-0012467 | A | | 2/2005 |
| KR | 10-2006-0054756 | A | | 5/2006 |

OTHER PUBLICATIONS

Extended European Search Report for corresponding European Application No. 06121444.1, dated Nov. 19, 2008, indicating the relevance of the cited references in this IDS.

Jai-Hwa Ryu, et al., "Experimental Observation and Modified Driving Method to Improve the High-Temperature Misfiring in AC PDP", IEEE Transactions on Electron Devices, vol. 51, No. 12, Dec. 2004, pp. 2026-2032, XP-001214236.

* cited by examiner

T1 and T2 : Varied depending on temperature

T3 : Varied depending on temperature

PLASMA DISPLAY PANEL AND METHOD FOR DRIVING SAME

CROSS-REFERENCE TO RELATED APPLICATION

This application claims priority to and the benefit of Korean Patent Application No. 10-2005-0091051 filed in the Korean Intellectual Property Office on Sep. 29, 2005, the entire content of which is incorporated herein by reference.

BACKGROUND OF THE INVENTION

1. Field of the Invention

The present invention relates to a plasma display panel (PDP) and a method for driving the same.

2. Description of the Related Art

A plasma display panel (PDP) is a flat display device using a plasma phenomenon, which is also called a gas-discharge phenomenon since a discharge is generated in the panel when a potential is applied to two electrodes separated from each other under a gas atmosphere in a non-vacuum state. Such a gas discharge phenomenon is used to display an image. Basically, a PDP has a matrix structure where electrodes are provided on opposing substrates and arranged to cross and face each other, and further including a discharge gas between two substrates.

Plasma display panels generally include two types: a direct current (DC) type and an alternating current (AC) type. Among them, the AC-PDPs are most widely used.

AC-PDPs have a basic structure in which electrodes are arranged to cross and face each other in a space between two substrates filled with a discharge gas. The space is partitioned with barrier ribs. One electrode is coated with a dielectric layer for forming wall charges thereon, and a phosphor layer is formed on the facing side of the other electrode.

Due to economic reasons, the barrier ribs and the dielectric layer are generally formed by printing methods, and the layers tend to be thick. However, such grown layers tend to have inferior qualities compared to those formed using a thin film fabrication process.

Therefore, there is a problem in that the dielectric layer and the electrode under the dielectric layer may be damaged by sputtering of electrons and ions generated from the discharge and thus the life-span of the AC-PDP may be shortened.

SUMMARY OF THE INVENTION

An exemplary embodiment of the present invention provides a plasma display panel (PDP) that can shorten response delay time by using extremely pure MgO to form a protective layer on the dielectric layer to prevent unstable discharge based on temperature, and a method for driving the same.

According to an embodiment of the present invention, a plasma display panel is provided which includes: a first substrate and a second substrate arranged substantially parallel to one another and spaced apart from one another; a plurality of address electrodes formed on the first substrate; a first dielectric layer formed on the first substrate and covering the address electrodes; a plurality of barrier ribs having a given height and forming a discharge space with the first dielectric layer; a phosphor layer formed in the discharge space; a plurality of sustain electrodes formed on the second substrate opposite the first substrate and arranged crossing the address electrodes; a second dielectric layer formed on the second substrate and covering the sustain electrodes; and a protective layer including MgO having a purity of at least 99.6% by weight and covering the second dielectric layer.

According to another embodiment of the present invention, a method for driving a plasma display panel is provided. The plasma display panel includes first electrodes and second electrodes formed on a first substrate and parallel to each other, third electrodes formed on a second substrate and crossing the first electrodes and the second electrodes, a dielectric layer formed on the second substrate and covering the first and second electrodes, and a protective layer covering the dielectric layer and having a purity of at least 99.6% by weight of MgO. The method includes: determining the temperature of the plasma display panel; applying a voltage that gradually decreases from a first voltage to a second voltage to the first electrodes; and sustaining application of the second voltage to the first electrode in a first period of a reset period, wherein the first period is varied according to the temperature of the plasma display panel.

DETAILED DESCRIPTION

An exemplary embodiment of the present invention will now be described in detail with reference to the accompanying drawings.

Figure 1:
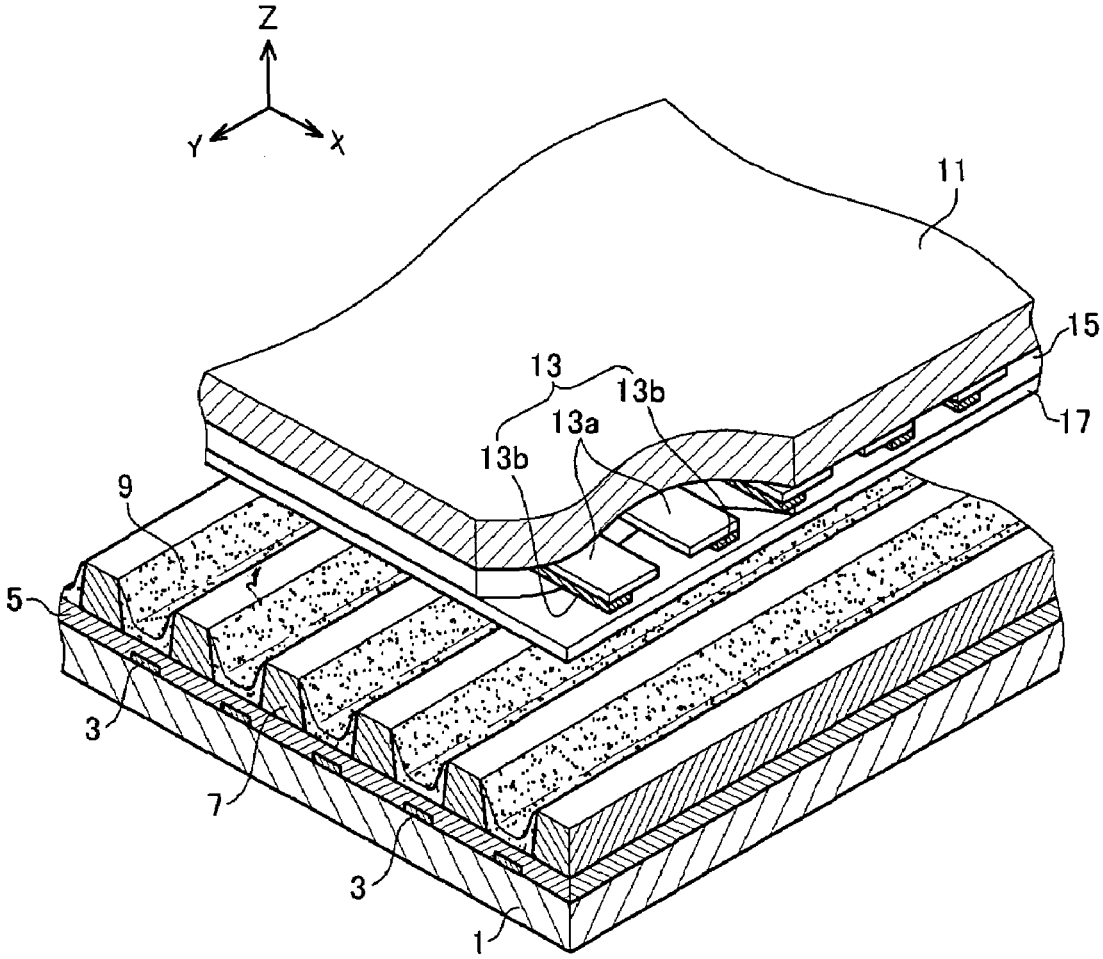
FIG. 1 is a perspective view showing the structure of a plasma display panel (PDP) in accordance with an embodiment of the present invention.

The present invention provides a protective layer for a plasma display panel (PDP), and an example of a PDP having the protective layer is shown in FIG. 1. As shown in FIG. 1, the plasma display panel of the present invention includes a first substrate 1 and a second substrate 11 the two substrates arranged generally parallel to and spaced apart from one another. A plurality of generally parallel address electrodes 3 are formed on the first substrate 1 along direction Y of FIG. 1, and a dielectric layer 5 is formed on the surface of the first substrate 1 and over the address electrodes 3. Barrier ribs 7 are arranged on the dielectric layer 5 parallel to the address electrodes and may be formed in an open or closed shape. Red (R), green (G), and blue (B) phosphor layers 9 are positioned on the dielectric layer 5 and between adjacent barrier ribs 7.

On the surface of the second substrate 11 facing the first substrate 1, a plurality of parallel display electrodes 13 are formed in direction X in FIG. 1 which is a direction generally perpendicular to the direction of the address electrodes. Each display electrode 13 comprises a pair of transparent electrodes 13*a* and a pair of bus electrodes where each transparent electrode 13*a* is further paired with a corresponding bus electrode 13*b*. A transparent dielectric layer 15 and a protective layer 17 are formed over the second substrate 11, and covering the display electrodes 13. One of the electrodes of the pair of electrodes of each display electrode 13 is a sustain electrode (X electrode), and the other is a scan electrode (Y electrode). A discharge cell is formed by each intersection of a particular address electrode 3 and a perpendicular display electrode 13, and is filled with a discharge gas.

The protective layer of the plasma display panel includes extremely pure MgO having a purity of at least 99.6% by weight, and more specifically a purity ranging from over 99.8% to 100% by weight. The extremely pure MgO may include an impurity selected from the group consisting of Ca, Al, Si, Fe, Zn, Na, Cr, Mn, and combinations thereof.

The extremely pure MgO may be a polycrystalline MgO prepared according to a sintering method. When the protective layer includes the extremely pure MgO prepared by a sintering method, it may have a quick response property but the discharge characteristic may be unstable depending on temperature. In particular, when the protective layer includes the extremely pure MgO prepared by a sintering method, wall charges may be unstable at low and high temperatures, and low discharge may occur.

When the temperature is low, charges are transferred slowly and thus the response rate of discharge becomes slow and it takes a somewhat long time to accumulate wall charges. Therefore, wall charges cannot be sufficiently accumulated using a reset period and the probability that address discharge is not completed within an address period is increased. This causes a problem of low discharge.

In contrast, when the temperature is high, charges are transferred fast and the discharge response rate becomes quick. Therefore, over-accumulated charges may be self-eliminated in the reset period or may be transferred into adjacent discharge cells before they are addressed. Since the wall charges cannot be accumulated sufficiently, there may also be a low discharge problem in which address discharge does not occur properly.

To avoid such problems in the operation of a plasma display panel that uses an extremely pure MgO protective layer that is prepared by a sintering method another embodiment of the invention involves a method for operating a plasma display panel.

Figure 2:
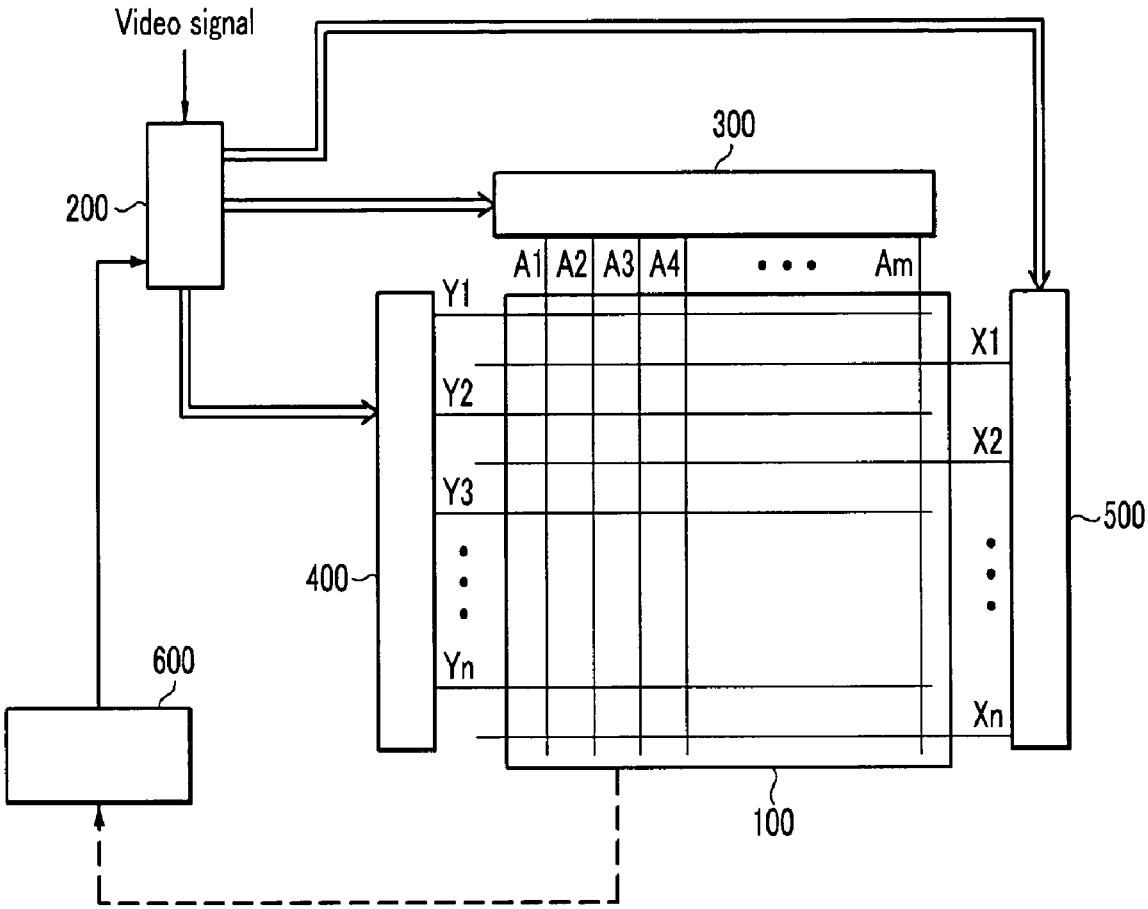
FIG. 2 is a block view illustrating the structure of a plasma display panel in accordance with an embodiment of the present invention.

FIG. 2 is a block view showing a structure of a plasma display panel 100 in accordance with an embodiment of the present invention. The plasma display panel 100 includes a plurality of address electrodes A1 to Am arranged in columns, and a plurality of sustain electrodes X1 to Xn and a plurality of scan electrodes Y1 to Yn arranged in rows with each sustain electrode paired with a scan electrode. The sustain electrodes X1 to Xn are disposed in opposite directions to the scan electrodes Y1 to Yn. The sustain electrodes X1 to Xn and the scan electrodes Y1 to Yn are respectively coupled to each other at one end of thereof. The plasma display panel 100 comprises a first substrate (not shown) where the address electrodes A1 to Am are arranged, and a second substrate (not shown) where the sustain electrodes X1 to Xn and the scan electrodes Y1 to Yn are arranged. The two substrates face one another with a discharge space between them such that the scan electrodes Y1 to Yn and the sustain electrodes X1 to Xn cross the address electrodes A1 to Am. Discharge cells are formed at the positions where the address electrodes A1 to Am cross an electrode pair comprising a sustain electrode X1 to Xn and a scan electrode Y1 to Yn. It should be apparent to one of skill that the structure of the plasma display panel 100 of FIG. 2 is just one example of a plasma display panel, and the present invention can be applied to plasma display panels of other structures to which the following driving waveform can be applied.

An address driver 300 receives an address driving control signal from a controller 200 and applies a display data signal for selecting a discharge cell to be displayed to a corresponding address electrode.

A sustain electrode driver 400 receives a sustain electrode driving control signal from the controller 200 and applies a driving voltage to the sustain electrodes X1 to Xn.

A scan electrode driver 500 receives a scan electrode driving control signal from the controller 200 and applies a driving voltage to the scan electrodes.

A temperature detector 600 senses the temperature of the plasma display panel 100 and transmits temperature information to the controller 200. It is possible to directly sense the temperature of the plasma display panel 100 by setting up a thermosensor inside of the plasma display panel 100, or to indirectly sense the temperature of the plasma display panel 100 by setting up a thermosensor at the back of the plasma display panel 100. Since methods for sensing the temperature of plasma display panels are known to those skilled in the art, a detailed description will not be provided here.

The controller 200 receives external video signals and outputs an address driving control signal, a sustain electrode driving control signal, and a scan electrode driving control signal. The controller 200 divides one frame into a plurality of subfields, and each subfield comprises a reset period, an address period, and a sustain period when the subfield is expressed based on temporal driving change. The reset period is for initializing the status of each discharge cell so as to facilitate an addressing operation on the discharge cell, and the address period is for accumulating wall charges by applying an address voltage to the addressed cells which are to be turned on, and to select cells to be turned on and cells to be turned off in the plasma display panel. The sustain period is for performing discharge to actually display images in the addressed cells by applying a sustain pulse.

According to an embodiment of the present invention, the controller 200 receives temperature information for the plasma display panel 100 from the temperature detector 600, and it generates a scan electrode driving control signal for varying a Vset voltage applying time (T1) or a Vnf voltage applying time (T2) in the reset period depending on the temperature of the plasma display panel 100. The scan electrode driving control signal generated in the controller 200 is transmitted to the scan electrode driver 500. The scan electrode driver 500 drives the scan electrodes to vary the Vset voltage applying time (T1) or the Vnf voltage applying time (T2) in the reset period based on the scan electrode driving control signal. When the temperature of the plasma display panel 100 is lower than a given temperature, the controller 200 causes wall charges to be sufficiently accumulated by increasing the Vset voltage applying time (T1). When the temperature of the plasma display panel 100 is higher than the given temperature, the controller 200 causes wall charges to be sufficiently accumulated by increasing the Vnf voltage applying time (T2).

A driving waveform to be applied to the scan electrodes Y1 to Yn, which will be simply referred to as Y, during the reset period for each subfield will now be described with reference to FIGS. 3 and 4.

Figure 3:
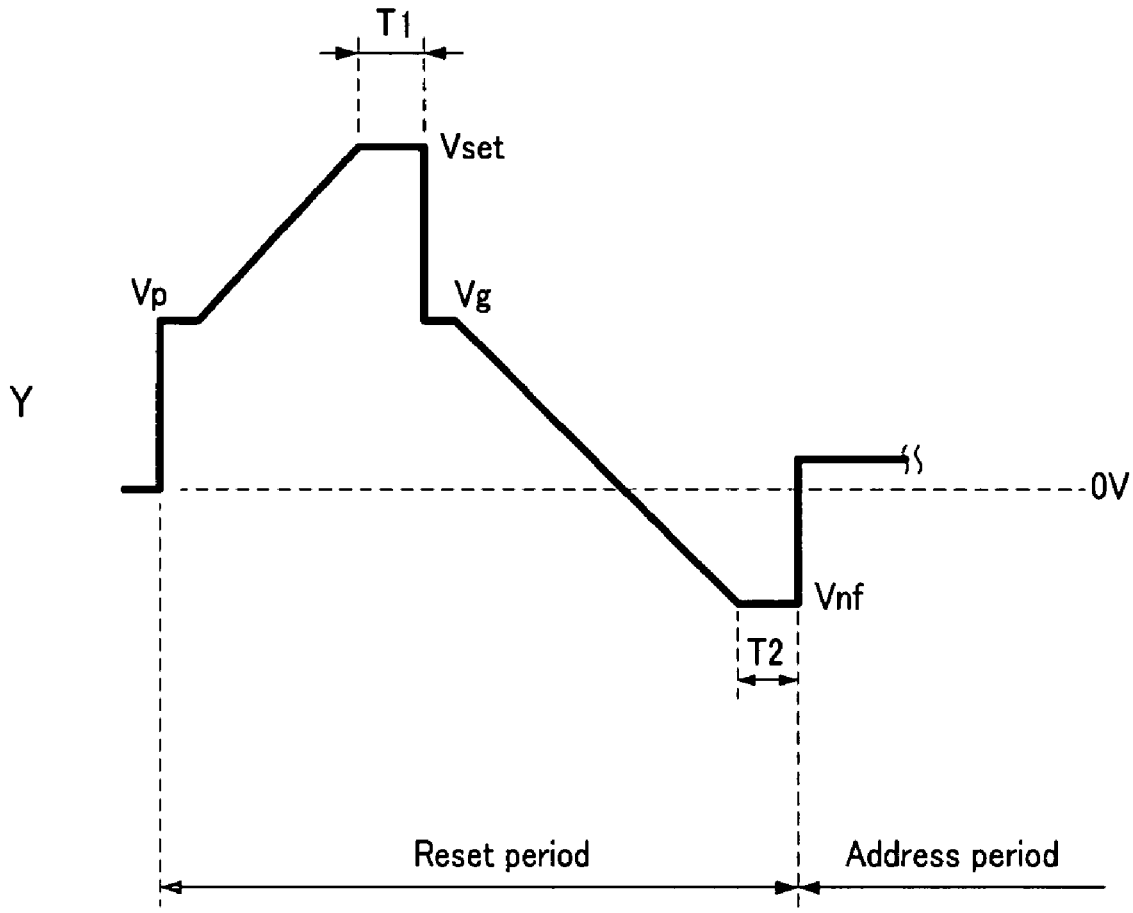
FIG. 3 shows a driving waveform of a plasma display panel according to an embodiment of the present invention.

FIG. 3 shows a driving waveform of a PDP in accordance with an embodiment of the present invention. FIG. 3 shows only a driving waveform applied to the scan electrodes Y in the reset period of each subfield, and driving waveforms applied to the address electrodes A1 to Am and the sustain electrodes X1 to Xn, which will be simply referred to as A and X, respectively, in the address period and the sustain period were omitted herein for the sake of convenience of description.

Referring to the waveform of FIG. 3, voltage gradually increases from voltage Vp to voltage Vset, and such voltage is applied to the scan electrodes Y during an increasing period of the reset period. Then, a weak reset discharge occurs from the scan electrodes Y to the address electrodes A and the sustain electrodes X, individually, to thereby generate negative wall charges in the scan electrodes Y and positive wall charges in the address electrodes A and the sustain electrodes X. When the voltage of the electrodes is gradually changed as shown in FIG. 3, weak discharge occurs in the discharge cells and walls charges are generated such that a summation of voltage applied from the outside and the wall voltage of the discharge cells is the same as the voltage status before discharge. This principle is disclosed in U.S. Pat. No. 5,745,086 by Weber which is incorporated by reference. Since all discharge cells should be initialized in the reset period, the Vset voltage should be sufficiently high to cause discharge in all cells.

Also, a Vset voltage having a T1 period is applied to the scan electrodes Y. The Vset voltage is applied for the T1 period to sufficiently accumulate negative wall charges in the scan electrodes Y and positive wall charges in the sustain electrodes X and the address electrodes A. In the embodiment of the present invention, the T1 period is varied according to the temperature of the plasma display panel. In other words, when a protective layer including the extremely pure MgO is prepared using a sintering method, walls charges are not sufficiently accumulated below a given first temperature level which is a low temperature level, and above a given second temperature level which is a high temperature level. Therefore, the T1 period is increased to sufficiently accumulate the wall charges generated during the weak discharge in the electrodes. The first temperature level and the second temperature level used to increase the T1 period are determined to be the temperatures at which the wall charges are not accumulated sufficiently according to the state of the plasma display panel. Such temperature levels can be determined through experiments known to those skilled in the art, and therefore, a detailed description will not be provided here.

Meanwhile, a voltage gradually decreasing from a Vg voltage to a Vnf voltage is applied to the scan electrodes Y in a falling period of the reset period. Although not shown in FIG. 3, a reference voltage, i.e., 0V, is applied to the address electrodes A, and a Ve voltage, which is a positive voltage, is applied to the sustain electrodes X. Then, weak reset discharge occurs between the scan electrodes Y and the sustain electrodes X and between the scan electrodes Y and the address electrodes A while the voltage of the scan electrodes Y decreases, and thus the negative wall charges generated in the scan electrodes Y and the positive wall charges formed in the sustain electrodes X and the address electrodes A are eliminated.

Subsequently, the Vnf voltage is applied to the scan electrodes Y, and sustained for a period T2 to sufficiently accumulate wall charges for addressing. The T2 period is varied depending on the temperature. In other words, when the protective layer includes the extremely pure MgO prepared by a sintering method, wall charges are not properly accumulated below a predetermined third temperature level, which is a low temperature, or above a predetermined fourth temperature level, which is a high temperature. Therefore, the T2 period is increased to properly accumulate wall charges in the electrodes during the weak discharge caused in a falling period of the reset period. The third temperature level and the fourth temperature level that are used to increase the T2 period are determined to be temperatures at which wall charges are not properly accumulated according to the status of the plasma display panel. The third temperature level and the fourth temperature level may be determined through experiments. According to the embodiment of the present invention, the T2 period is controlled to be more than or equal to 40 μs to accumulate wall charges sufficiently. The T2 period may be controlled to be shorter than or equal to 60 μs. The method for determining the third temperature and the fourth temperature is known to those skilled in the art, and a detailed description will not be provided here.

While FIG. 3 shows a waveform obtained by applying a gradually increasing voltage and a gradually decreasing voltage to the scan electrodes Y in the reset period, it is possible to perform a reset by applying a gradually decreasing waveform to the scan electrode Y.

Figure 4:
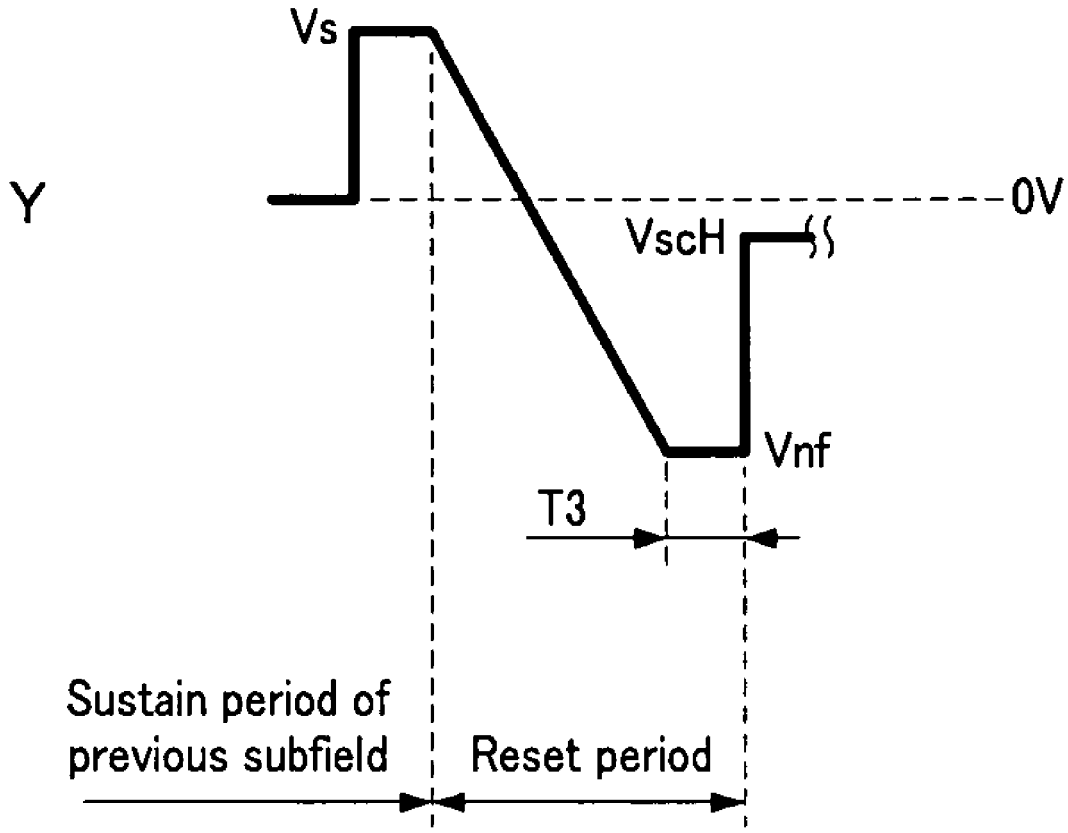
FIG. 4 shows a driving waveform of a plasma display panel according to another embodiment of the present invention.
Figure 5:
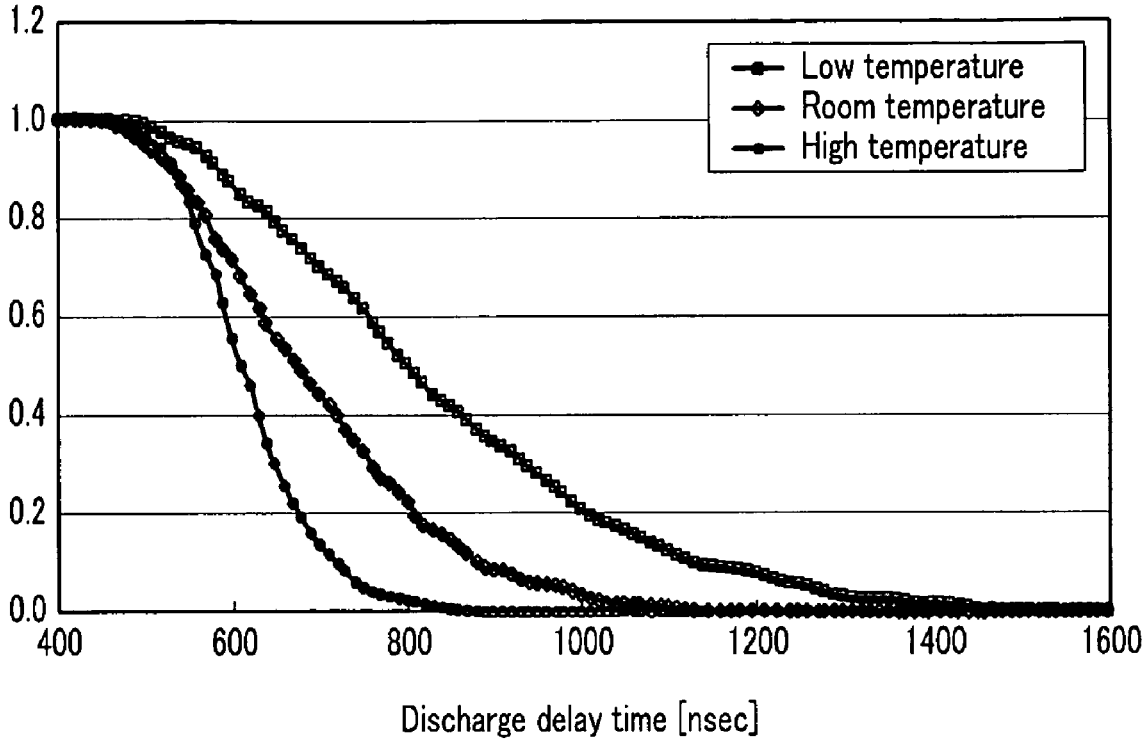
FIG. 5 is a graph showing the discharge delay time of a plasma display panel prepared according to Example 1.
Figure 6:
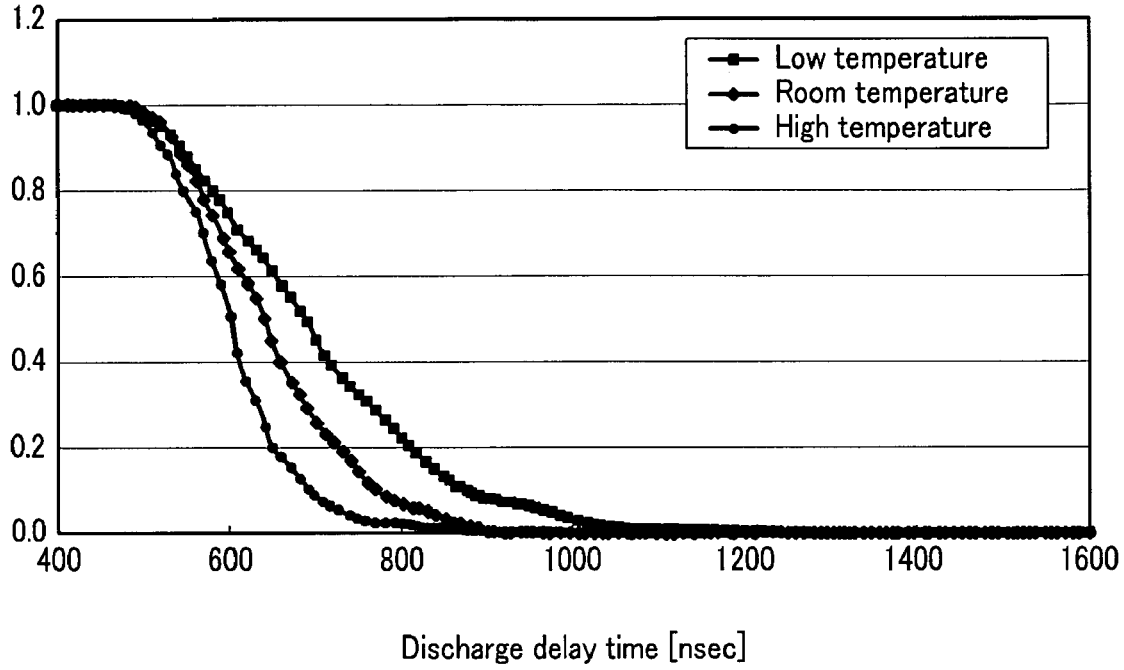
FIG. 6 is a graph showing the discharge delay time of a plasma display panel prepared according to Example 2.
Figure 7:
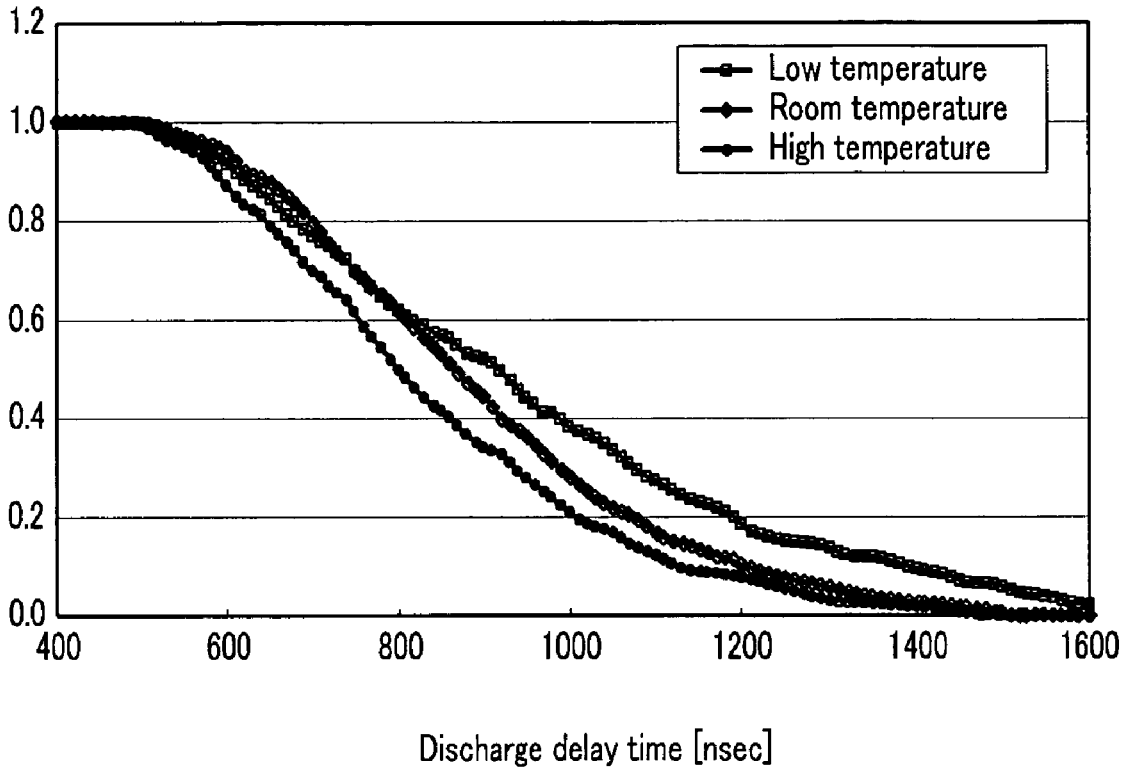
FIG. 7 is a graph showing the discharge delay time of a plasma display panel prepared according to Comparative Example 1.
Figure 8:
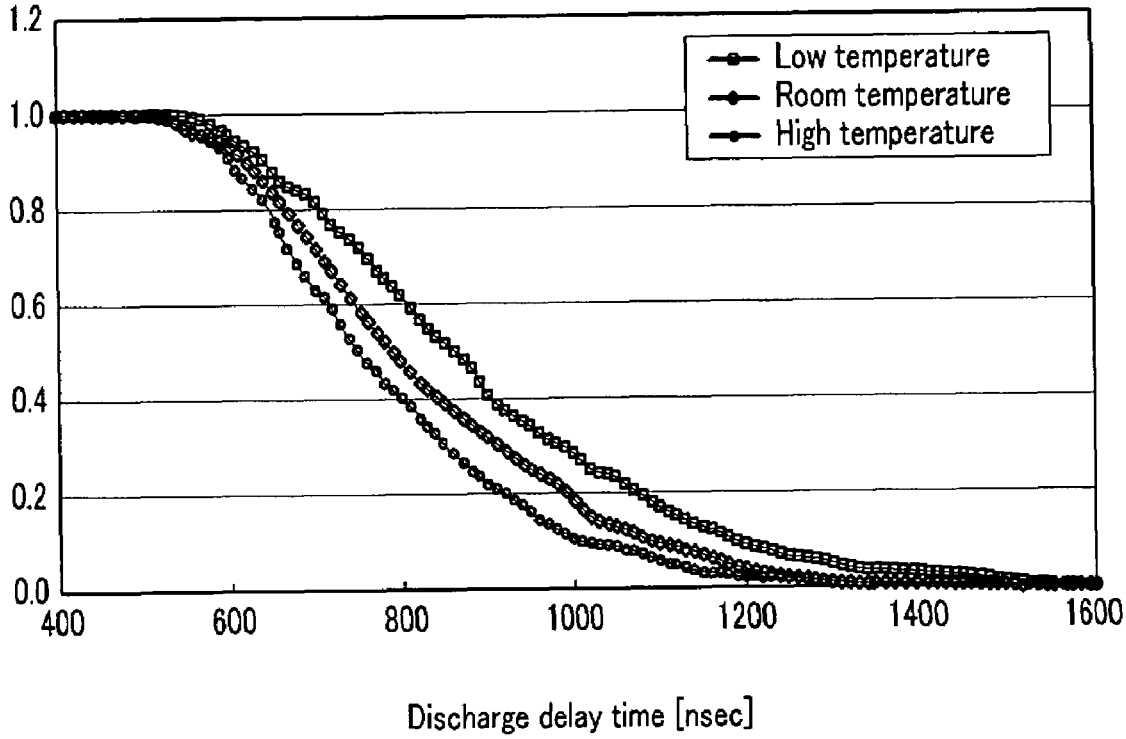
FIG. 8 is a graph showing the discharge delay time of a plasma display panel prepared according to Comparative Example 2.

FIG. 4 shows a driving waveform of the plasma display panel in accordance with another embodiment of the present invention.

As shown in FIG. 4, voltage gradually decreases from a Vs voltage to a Vnf voltage, and such voltage is applied to the scan electrodes Y in the reset period of Example 2. Herein, the Vs voltage is a sustain discharge pulse voltage applied in the sustain period of a previous subfield. When only a gradually decreasing voltage is applied to the scan electrodes Y, reset discharge occurs only in the discharge cells selected in the previous subfield to thereby generate wall charges sufficient for addressing. The reset discharge does not occur in the discharge cells not selected in the previous subfield, and the status of wall charges after the reset period of the previous subfield is sustained. U.S. Pat. No. 6,294,875 to Kurata et al. discloses details thereof and is incorporated by reference. In another embodiment of the present invention, the Vnf voltage applying time (T3) is also varied according to temperature, just as in the first embodiment. Since the method of varying the T3 period according to temperature is the same as that of the first embodiment, a detailed description will not be provided here. The T3 period may be controlled to be greater than or equal to 40 μs to sufficiently accumulate wall charges. The T3 period may also be controlled to be shorter than or equal to 70 μs.

As described above, when the protective layer includes the extremely pure MgO prepared by a sintering method, the low discharge problem can be resolved by varying the Vset voltage applying time or the Vnf voltage applying time according to the temperature of the plasma display panel in order to sufficiently accumulate the wall charges as shown in the embodiments of the present invention described above.

The following examples illustrate the present invention in more detail. However, it is understood that the present invention is not limited by these examples.

EXAMPLE 1

Stripe-type sustain electrodes were formed of an indium tin oxide conductive material on an upper substrate formed of soda lime glass using a conventional sustain electrode forming method.

A dielectric layer was then formed over the sustain electrodes and on the upper substrate by coating the entire surface of the upper substrate with a lead-based glass paste and baking the upper substrate.

An upper panel was prepared by forming a protective layer of a MgO compound on the dielectric layer by using a sputtering method. The MgO compound was prepared through a sintering process, and had a purity of at least 99.6% by weight. The impurities of the MgO compound are revealed in Table 1 below.

EXAMPLE 2

The same process as in Example 1 was carried out, except that the waveforms of FIGS. 3 and 4 were applied to the plasma display panel prepared in accordance with Example 1.

COMPARATIVE EXAMPLE 1

The same process as in Example 1 was carried out, except that a MgO compound including the impurities shown in Table 1 was used. The purity of the MgO compound can be calculated from the contents of the impurities by subtracting the contents of the impurities from the MgO compound.

COMPARATIVE EXAMPLE 2

The same process as in Example 1 was carried out, except that a MgO compound including the impurities shown in Table 1 was used. The purity of the MgO compound can be calculated from the contents of the impurities by subtracting the contents of the impurities from the MgO compound.

The contents of the MgO compound used in Example 1 and Comparative Examples 1 and 2 are shown in the following Table 1. Since the impurity contents of Example 2 were the same as in Example 1, they are not presented in Table 1.

TABLE 1

| | Impurities (ppm) | | | | | | | |
|---|---|---|---|---|---|---|---|---|
| | Ca | Al | Si | Fe | Zn | Na | Cr | Mn |
| Comparative Example 1 | 253.1 | 105.6 | 9.4 | 75.6 | 0.6 | 0.6 | 9.1 | 9.4 |
| Comparative Example 2 | 171.9 | 84.6 | 8.9 | 58.2 | 0.5 | 0.7 | 8.7 | 8.2 |
| Example 1 | 12.5 | 15.4 | 13.7 | 5.2 | 2.6 | 0.8 | Not detected | 3.1 |

Discharge delay times for the plasma display panels prepared in accordance with Examples 1 and 2 and Comparative Examples 1 and 2 were measured at a low temperature (−10° C.), at room temperature (25° C.), and at a high temperature (60° C.), and the results are presented in FIGS. 5 to 8. The discharge delay times at each temperature are presented in Table 2. In FIGS. 5 to 8, the y-axis indicates a relative discharge failure index.

TABLE 2

| | Low temperature (nsec) | Room temperature (nsec) | High temperature (nsec) |
|---|---|---|---|
| Comparative Example 1 | 517 | 421 | 378 |
| Comparative Example 2 | 489 | 395 | 352 |
| Example 1 | 413 | 206 | 171 |
| Example 2 | 246 | 183 | 139 |

As shown in Table 2 and FIGS. 5 to 8, the discharge delay time is different according to temperature, and the discharge delay times of Example 1 and 2 were remarkably shorter than those of Comparative Examples 1 and 2.

The present invention can stabilize discharge where a plasma display panel includes a protective layer including an extremely pure MgO prepared by a sintering method, by varying a Vset applying time or a Vnf voltage applying time according to the temperature of the plasma display panel in order to sufficiently accumulate wall charges in the reset period.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel comprising first and second generally parallel substrates; first electrodes and second electrodes formed on the second substrate and generally parallel to one another; third electrodes formed on the first substrate, generally parallel to one another and crossing the first electrodes and the second electrodes; and a dielectric layer over the first and second electrodes and the second substrate, the method comprising:

determining the temperature of the plasma display panel;

applying a voltage to the first electrodes that gradually decreases from a first voltage to a second voltage; and sustaining application of the second voltage to the first electrode in a first period of a reset period where the first period is varied according to the temperature of the plasma display panel.

2. The method of claim 1, wherein the first period is longer than 40 μs.

3. The method of claim 1, wherein the plasma display panel further comprises a protective layer including MgO having a purity of at least 99.6% by weight and covering the dielectric layer.

4. The method of claim 1, wherein the voltage gradually increases from a third voltage to a fourth voltage before the first voltage is applied to the first electrodes, and the fourth voltage is sustained for a second period.

5. The method of claim 4, wherein the second period is varied according to the temperature of the plasma display panel.

6. The method of claim 4, wherein the second period is at least 40 μs.

7. The method of claim 5, wherein the second period is increased when the temperature of the plasma display panel is higher than a first temperature level or lower than a second temperature level which is lower than the first temperature level.

8. The method of claim 1, wherein the first period is increased when the temperature of the plasma display panel is higher than a first temperature level or lower than a second temperature level which is lower than the first temperature level.

* * * * *